US006474311B1

(12) United States Patent
Sawada et al.

(10) Patent No.: US 6,474,311 B1
(45) Date of Patent: Nov. 5, 2002

(54) FUEL TANK FOR ENGINE

(75) Inventors: Toshiharu Sawada, Fuchu (JP); Hiroshi Kato, Hachiouji (JP); Takeshi Watanabe, Nishitokyo (JP)

(73) Assignee: Komatsu Zenoah Co., Kawagoe (JP)

( * ) Notice: Subject to any disclaimer, the term of this patent is extended or adjusted under 35 U.S.C. 154(b) by 0 days.

(21) Appl. No.: 09/830,789

(22) PCT Filed: Oct. 28, 1999

(86) PCT No.: PCT/JP99/05975

§ 371 (c)(1),
(2), (4) Date: Apr. 30, 2001

(87) PCT Pub. No.: WO00/26519

PCT Pub. Date: May 11, 2000

(30) Foreign Application Priority Data

Oct. 30, 1998 (JP) ..... 10-324466

(51) Int. Cl.[7] ..... F02M 37/04
(52) U.S. Cl. ..... 123/516; 123/41.31
(58) Field of Search ..... 123/516, 41.56, 123/41.31, 3, 41.63, 41.65, 41.7

(56) References Cited

U.S. PATENT DOCUMENTS 4,757,872 A * 7/1988 Inomata ..... 180/291
4,909,530 A * 3/1990 Tsukada ..... 180/296
4,930,811 A * 6/1990 Tsukada ..... 280/834
5,199,389 A * 4/1993 Wolf et al. ..... 123/41.7
5,924,393 A * 7/1999 Kiluchi ..... 123/2
6,079,374 A * 6/2000 Yamamoto et al. ..... 123/41.7

FOREIGN PATENT DOCUMENTS

| | | | |
|---|---|---|---|
| JP | 54-36166 | Y2 | 11/1979 |
| JP | 56-53051 | Y2 | 12/1981 |
| JP | 59-108826 | A | 6/1984 |
| JP | 2-5067 | Y2 | 2/1990 |
| JP | 6-8045 | U | 2/1994 |
| JP | 7-10436 | U | 2/1995 |

* cited by examiner

*Primary Examiner*—Thomas N. Moulis
(74) *Attorney, Agent, or Firm*—Sidley Austin Brown & Wood LLP

(57) ABSTRACT

A fuel tank for an engine capable of preventing the temperature of the fuel tank from rising and grass from entering a cooling fan, and being low in production cost with a simple structure is provided. To this end, in the fuel tank for an engine installed on a crankcase (2) of an engine (1) and having a face opposing a muffler (7), a heat insulating part (22) integrally formed is provided on the face opposing the muffler (7). Further, a stand part (25) integrally formed is provided.

17 Claims, 4 Drawing Sheets

FUEL TANK FOR ENGINE

TECHNICAL FIELD

The present invention relates to a fuel tank for an engine, and it particularly relates to a fuel tank for a small-sized portable engine of a mowing machine or the like.

BACKGROUND

In a small-sized portable engine used for a mowing machine or the like, a fuel tank is generally installed on a lower part of the engine, and is made of resin for reduction in weight. The fuel tank is located near a muffler for reduction in size of the entire body of the engine, whereby it is also located in the place that is easily influenced by heat.

Fuel tanks are conventionally made of, for example, polyethylene, and in many cases, made by blow molding. However, since blow-molded polyethylene has low heat resistance, it is necessary to prevent an increase in temperature caused by the heat of the muffler, and therefore, a heat insulating plate being a separate component is provided between the muffler and the fuel tank. Japanese Utility Model Application Publication No. 56-53051 discloses one of the examples. According to Japanese Utility Model Application Publication No. 56-53051, an insulating body projected to a side portion of a crankcase is provided between a muffler and a fuel tank, and a lower portion of a muffler cover is connected to the insulating body to eliminate a space between the crankcase and the muffler to insulate the muffler from heat and prevent the temperature of the fuel tank from rising.

Further, since polyethylene has low abrasion resistance, the stands for placing the engine on the ground and the like are attached as separate components. Japanese Utility Model Application Publication No. 54-36166 discloses an example of this. According to Japanese Utility Model Application Publication No. 54-36166, it has the structure in which the fuel tank is installed on the engine body with use of a band and the band is provided with stand parts.

Further, in mowing machines, the cooling fan takes in scattering grass, which attaches to the cooling fan and the cooling fins of the cylinder, whereby cooling performance is reduced. As a countermeasure against this, in some mowing machines, a grass entry preventing guard is attached near the air inlet port of the cooling fan as a separate component.

However, in the structures of the conventional engines as described above, the insulating plates, the stands, and possibly the grass entry preventing guard are attached as separate components. This results in complicated structures, a large number of components, and many man-hours needed for assembly. This causes the disadvantage of increasing the cost of the engine.

SUMMARY OF THE INVENTION

The present invention is made in view of the aforementioned disadvantages, and its object is to provide a fuel tank for an engine in which the production cost can be reduced, due to a simple structure and less components.

In order to attain the aforementioned objects, a first aspect of a fuel tank for an engine according to the present invention is a fuel tank installed on a crankcase of an engine, having a face opposing a muffler, and a heat insulating part integrally formed on the face of the fuel tank opposing the muffler.

According to the above configuration, to prevent the temperature of the fuel tank from rising due to the heat of the muffler, a heat insulating part is integrally formed, thus causing the number of the components to be reduced, and a reduction in the number of man-hours for assembly. Accordingly, the engine can be produced at low cost.

A second aspect of the fuel tank for the engine according to the present invention is a fuel tank installed on an engine, with a stand part integrally formed.

According to the above configuration, since the fuel tank is provided with the stand part, the engine and the fuel tank can be placed with stability by means of the stand part. Further, since the stand part is integrally formed, the number of components and the number of man-hours for assembly are reduced, thus making it possible to produce the engine at low cost.

A third aspect of the fuel tank for the engine according to the present invention is a fuel tank installed on the engine via a space communicating with a cooling air inlet port through which cooling air for the engine is taken in by means of a cooling fan.

Grass entry preventing plates for preventing grass from entering the cooling air inlet port are integrally formed on an outer face facing the space communicating with the cooling air inlet port.

According to the above configuration, since the grass entry preventing plates are provided, grass collides against the grass entry preventing plates and falls, thus making it possible to prevent grass from being caught in the cooling fan and the cooling fins of the cylinder and reducing cooling performance. Further, since the grass entry preventing plates are integrally formed, the number of components and the man-hours needed for assembly are reduced, thus making it possible to produce the engine at low cost.

BEST MODE FOR CARRYING OUT THE INVENTION

A preferred embodiment of a fuel tank for an engine according to the present invention will be explained in detail below with reference to FIGS. 1–4.

Figure 1:
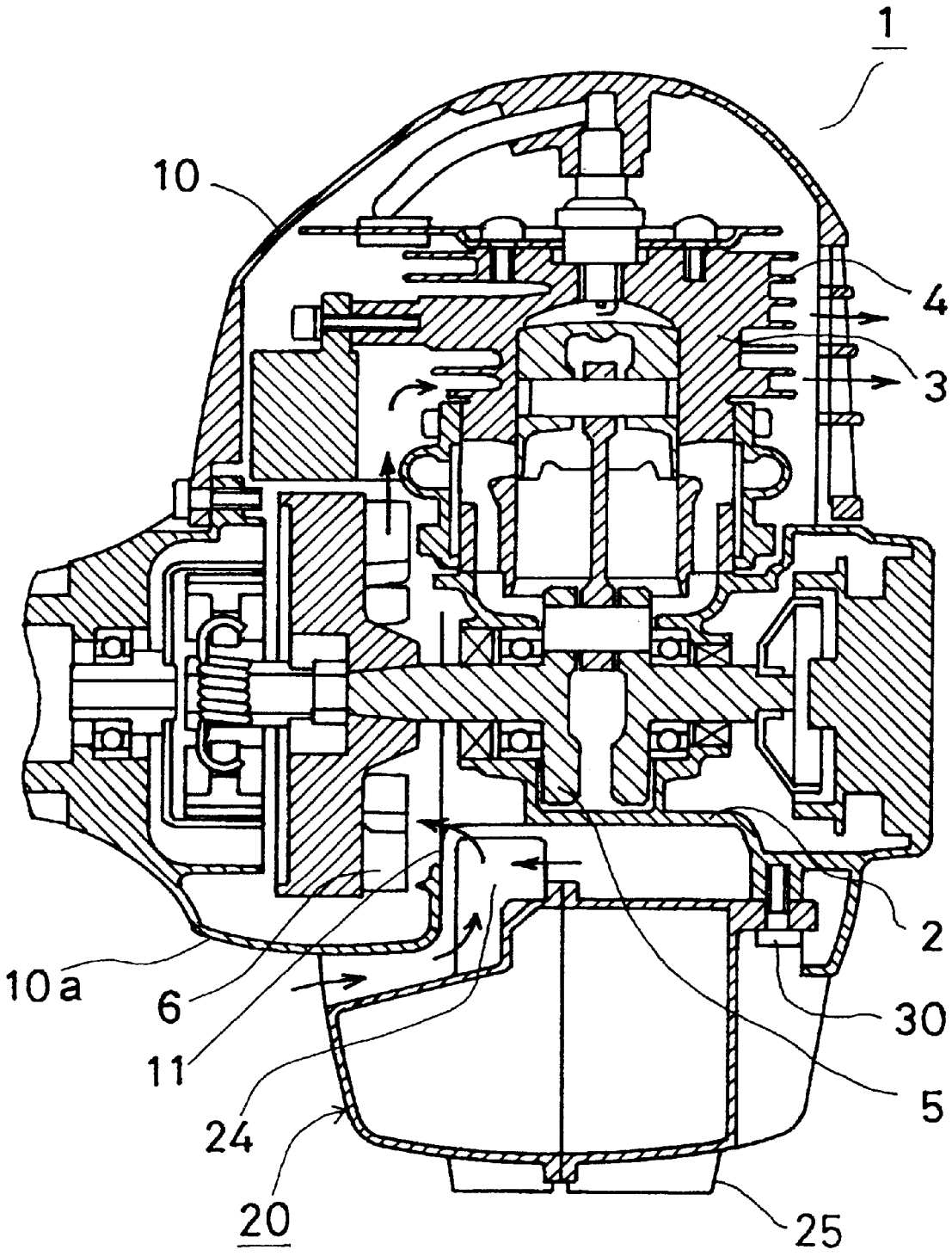
FIG. 1 is a sectional side view of a small-sized air cooling engine having a fuel tank of the present invention.
Figure 2:
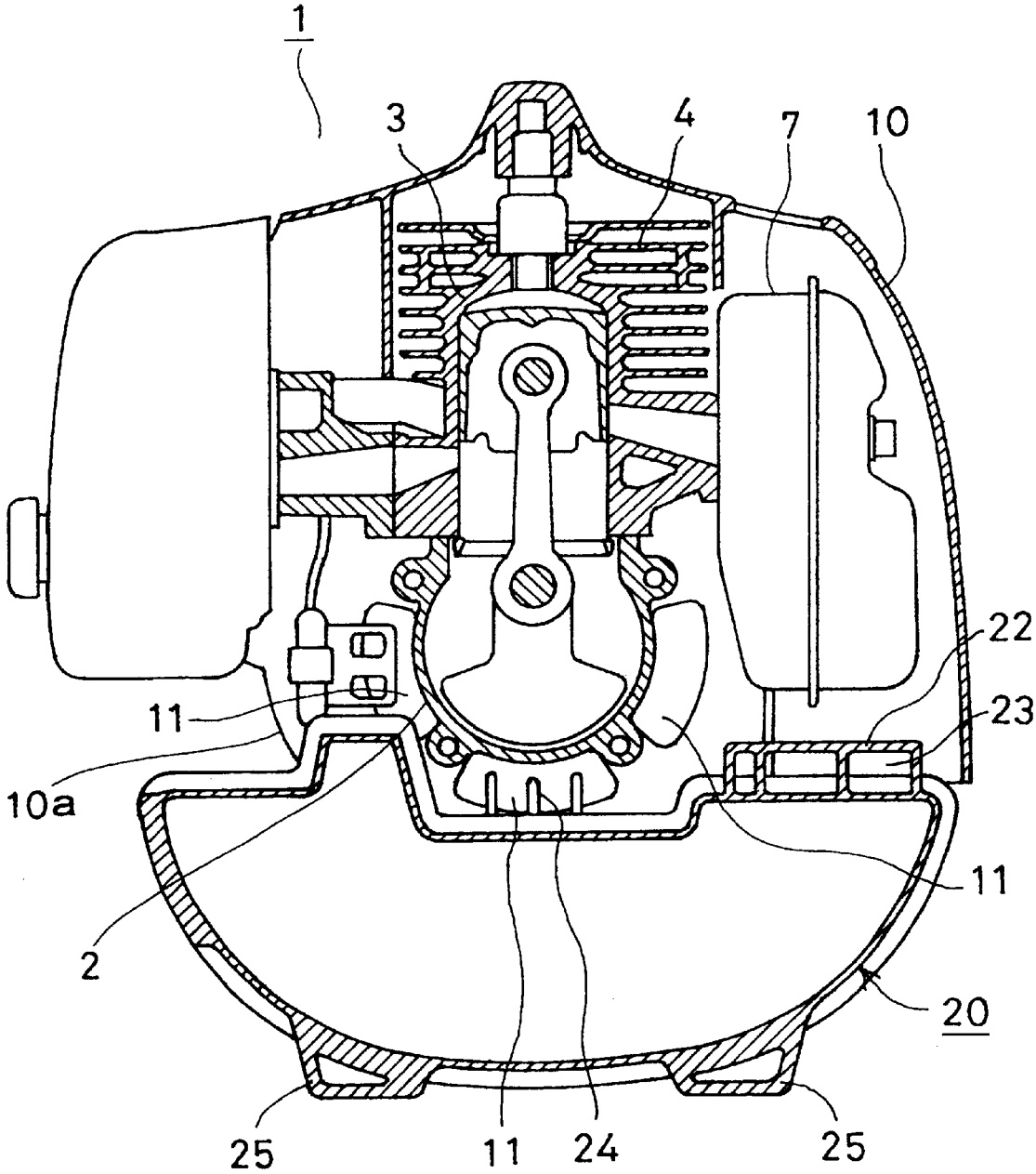
FIG. 2 is a sectional front view of the small-sized air cooling engine having the fuel tank of the present invention.

FIG. 1 is a sectional side view of a small-sized portable air-cooling type of engine 1 onto which the fuel tank according to the present invention is installed, and FIG. 2 is a sectional front view. At a top portion of a crankcase 2, attached is a cylinder 3 having cooling fins 4. A cooling fan 6 is attached at one end portion of a crankshaft 5 provided in a crank chamber of the crankcase 2. A fuel tank 20 is fastened by a bolt 30 under the crankcase 2. As shown in FIG. 2, a muffler 7 is attached on a side face portion of the cylinder 3, and part of the fuel tank 20 is located under the muffler 7. An upper portion of the engine 1 is covered with a cover 10. A portion under the cooling fan 6 and a portion of the cooling fan 6 at the side of the crankcase 2 are covered with a cover 10*a*. The cover 10*a* with which the cooling fan 6 is covered is provided with cooling air inlet ports 11 at three spots, as shown in FIG. 2. The fuel tank 20 is installed on the crankcase 2 with a space communicating with the cooling air inlet ports 11. As shown by the arrows in FIG. 1, cooling air is taken in through the cooling air inlet ports 11 by the cooling fan 6; and via the cooling fan 6, the cooling air is passed between the cooling fins 4 of the cylinder 3 to be discharged outside.

A heat insulating part 22, in a flat plate form, having a hollow portion 23 between the heat insulating part 22 and the fuel tank 20 is provided on a face, which opposes the engine muffler 7, of a top face of a fuel tank 20. A plurality of grass entry preventing plates 24 are provided at an entrance portion of the cooling air inlet port 11 of the fuel tank 20, and stand parts 25 are provided on an underside face of the fuel tank 20.

Figure 3:
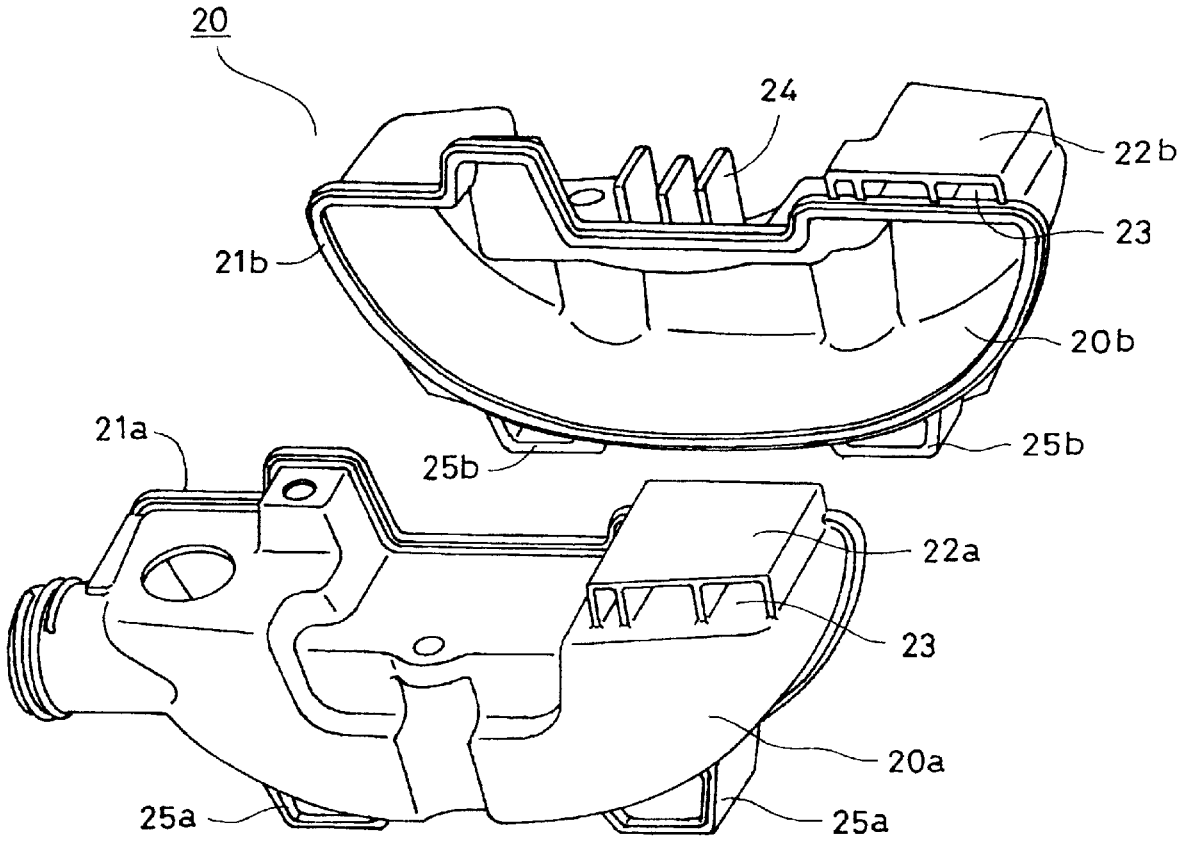
FIG. 3 is a perspective view showing a configuration of the fuel tank of the present invention.

The fuel tank 20 will be explained in detail below. FIG. 3 is a perspective view showing a configuration of the fuel tank 20. The fuel tank 20 is defined by a first tank member 20*a* and a second tank member 20*b*. The first tank member 20*a* and the second tank member 20*b* are made of polyamide, and are injection-molded. The first tank member 20*a* and the second tank member 20*b* are formed into the shape which is made by splitting the fuel tank 20 into two in a lateral direction of the crankshaft 5, and each tank member has an opening on its split surface. At upper portions of one end side of the first tank member 20*a*, and second tank member 20*b*, integrally molded are a first heat insulating part 22*a* and a second heat insulating part 22*b*. Each heat insulating part has a hollow portion 23. At lower portions, of the first and second tank members, integrally molded, are a first stand part 25*a* and a second stand part 25*b*, respectively. Further, the grass entry preventing plates 24 are integrally molded at an upper portion of the second tank member 20*b*.

Figure 4:
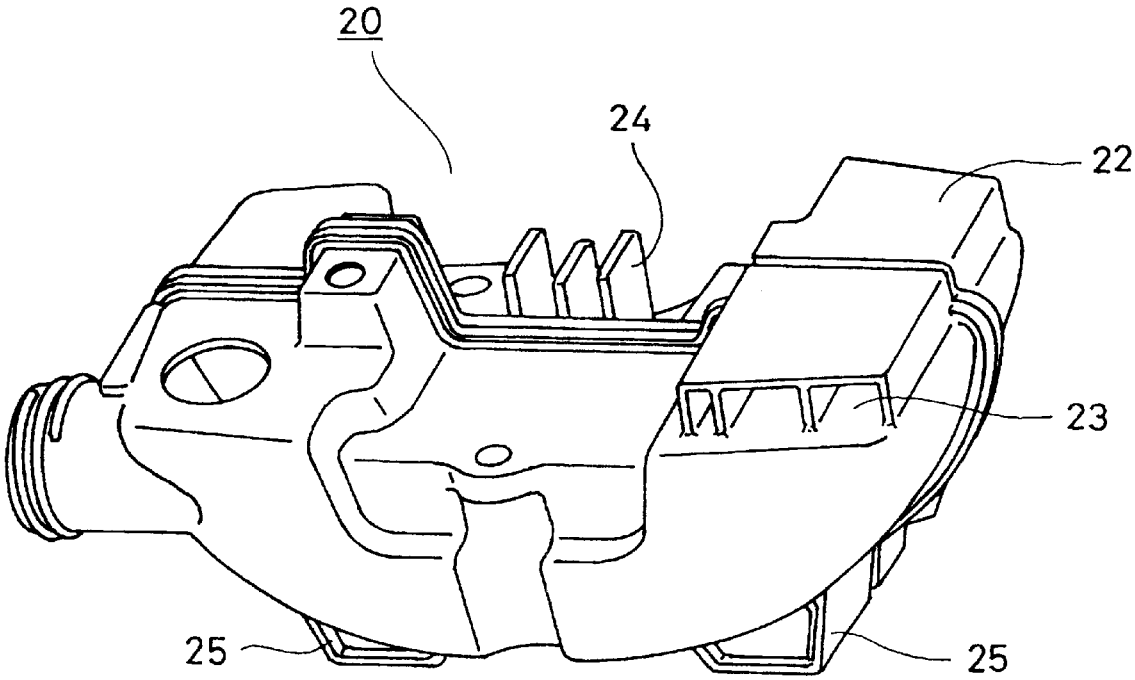
FIG. 4 is a perspective view of the fuel tank of the present invention.

Joining areas 21*a* and 21*b* are provided at peripheral portions of the aforementioned openings of the first tank member 20*a* and the second tank member 20*b*. On forming the fuel tank 20 by the first tank member 20*a* and the second tank member 20*b*, the joining area 21*a* and the joining area 21*b* are brought into contact, and the joining areas 21*a* and 21*b* are given pressure and vibration by a vibration welder and welded. FIG. 4 is a perspective view of the entire fuel tank 20 formed by welding the first tank member 20*a* and the second tank member 20*b*. The fuel tank 20 includes the heat insulating part 22 on the upper portion at one end side, the grass entry preventing plates 24 on the upper portion almost in the center, and the stands 25 on the lower portion respectively.

Next, the effects of the present invention will be explained. The fuel tank 20 of the present invention is made of polyamide as described above. Since polyamide has high heat resistance, the heat insulating part 22 can resist heat of the muffler 7. In addition, the hollow portion 23 provided in the heat insulating part 22, reduces heat conduction to the main body of the fuel tank 20, thus making it possible to prevent the temperature from rising. Further, since polyamide has high abrasion resistance, wear of the stands 25 reduces even if the stands 25 are integrally molded, and thus long life can be secured. The grass entry preventing plates 24 are provided on the upper face of the fuel tank 20, which faces a space connecting to the cooling air inlet port 11, near the cooling air inlet port 11. As a result, grass, scattered by a mowing operation and the like, collides against the grass entry preventing plates 24 and falls, thus making it possible to prevent grass from attaching to the cooling fan 6 and the cooling fins 4 of the cylinder 3 and reducing cooling efficiency. In addition, since the heat insulating part 22, the grass entry preventing plates 24, and the stand parts 25, are integrally molded with the fuel tank 20, the number of components can be reduced and the number of man-hours for assembly can be reduced, thus making it possible to produce the engine 1 at low cost.

What is claimed is:

1. A fuel tank for an engine installed on a crankcase of an engine and having a face opposing a muffler, wherein a heat insulating part is integrally formed and provided on said face opposing said muffler, and said heat insulating part has a hollow portion provided in said heat insulating part between said heat insulating part and said fuel tank.

2. A fuel tank for an engine installed on an engine, wherein a plurality of stand parts integrally formed are provided, and said plurality of stand parts are formed at positions to allow an assembly assembled from said engine and said fuel tank to be placed with stability via respective ground contact face portions of said plurality of stand parts.

3. A fuel tank for an engine installed on an engine at a position proximate to a space communicating with a cooling air inlet port through which cooling air for said engine is taken in by means of a cooling fan, wherein grass entry preventing plates having planes along a flow direction of said cooling air taken in for preventing grass from entering said cooling air inlet port are integrally formed on an outer face of said fuel tank which faces the space communicating with said cooling air inlet port.

4. A fuel tank for the engine in accordance with claim 1, wherein said heat insulating part is constructed by a flat plate.

5. A fuel tank suitable for installation on an engine in proximity to a muffler, said fuel tank comprising:

a fuel cavity; and an insulated portion integrally formed as part of said fuel tank;

wherein said insulated portion is on a side of said fuel tank which would face the muffler;

wherein said insulated portion comprises a heat insulating member and an air cavity provided in said heat insulating member; and wherein said air cavity is located so as to be between said fuel cavity and said heat insulating member to reduce heat conduction between the muffler and the fuel cavity.

6. A fuel tank as claimed in claim 5 wherein said heat insulating member comprises a flat plate.

7. A fuel tank suitable for installation on an engine in proximity to a muffler, said fuel tank comprising:

a fuel cavity; and an insulated portion integrally formed as part of said fuel tank;

wherein said insulated portion is on a side of said fuel tank which would face the muffler;

wherein said insulated portion comprises a heat insulating member and an air cavity;

wherein said air cavity is located so as to be between said fuel cavity and said heat insulating member to reduce heat conduction between the muffler and the fuel cavity;

wherein said fuel tank further comprises a plurality of stands integrally molded as part of at least one side of said fuel tank; and wherein said stands are adapted to provide stability of said fuel tank when said fuel tank is positioned with said stands on a support surface.

8. A fuel tank as claimed in claim 5 further comprising at least one grass entry prevention member;

wherein said at least one grass entry prevention member being integrally formed as part of said fuel tank;

wherein said at least one grass entry prevention member being located so as to be near an air inlet port of the engine in order to prevent grass from entering the air inlet port; and each of said at least one grass entry prevention member being planar along a flow direction of air entering said air inlet port.

9. An apparatus comprising:

an air-cooled internal combustion engine having a muffler; and a fuel tank installed on said engine in proximity to the muffler; said fuel tank comprising:

a fuel cavity; and an insulated portion integrally formed as part of said fuel tank;

wherein said insulated portion is on a side of said fuel tank which faces the muffler;

wherein said insulated portion comprises a heat insulating member and an air cavity provided in said heat insulating member; and wherein said air cavity is located so as to be between said fuel cavity and said heat insulating member to reduce heat conduction between the muffler and the fuel cavity.

10. An apparatus as claimed in claim 9 wherein said heat insulating member comprises a flat plate.

11. An apparatus comprising:

an air-cooled internal combustion engine having a muffler; and a fuel tank installed on said engine in proximity to the muffler; said fuel tank comprising:

a fuel cavity; and an insulated portion integrally formed as part of said fuel tank;

wherein said insulated portion is on a side of said fuel tank which faces the muffler;

wherein said insulated portion comprises a heat insulating member and an air cavity;

wherein said air cavity is located so as to be between said fuel cavity and said heat insulating member to reduce heat conduction between the muffler and the fuel cavity;

wherein said fuel tank further comprises a plurality of stands integrally molded as part of at least one side of said fuel tank; and wherein said stands are adapted to provide stability of said fuel tank when said fuel tank is positioned with said stands on a support surface.

12. An apparatus as claimed in claim 9 wherein said fuel tank further comprises at least one grass entry prevention member;

wherein said at least one grass entry prevention member being integrally formed as part of said fuel tank;

wherein said at least one grass entry prevention member being located so as to be near an air inlet port of the engine in order to prevent grass from entering the air inlet port; and each of said at least one grass entry prevention member being planar along a flow direction of air entering said air inlet port.

13. A fuel tank suitable for installation on an engine in proximity to a muffler, said fuel tank comprising:

a first fuel tank member having a first fuel cavity therein; and wherein said first fuel tank member comprises a first insulated portion integrally formed as part of said first fuel tank member;

wherein said first insulated portion is on a side of said first fuel tank member which would face the muffler;

wherein said first insulated portion comprises a first heat insulating member and a first air cavity;

wherein said first air cavity is located so as to be between said first fuel cavity and said first heat insulating member to reduce heat conduction between the muffler and the first fuel cavity;

a second fuel tank member having a second fuel cavity therein;

wherein said second fuel tank member comprises a second insulated portion integrally formed as part of said second fuel tank member;

wherein said second insulated portion is on a side of said second fuel tank member which would face the muffler;

wherein said second insulated portion comprises a second heat insulating member and a second air cavity;

wherein said second air cavity is located so as to be between said second fuel cavity and said second heat insulating member to reduce heat conduction between the muffler and the second fuel cavity;

wherein said first fuel tank member and said second fuel tank member are attached so as to form a fuel tank.

14. A fuel tank as claimed in claim 13 wherein said fuel tank is made of polyamide.

15. A fuel tank as claimed in claim 13 wherein said first heat insulating member and said second heat insulating member are comprised of a flat plate.

16. A fuel tank as claimed in claim 13 wherein said fuel tank further comprises a plurality of stands integrally molded as part of at least one side of at least one of said first fuel tank member and said second fuel tank member; and wherein said stands are adapted to provide stability of said fuel tank when said fuel tank is positioned with said stands on a support surface.

17. A fuel tank as claimed in claim 13 further comprising at least one grass entry prevention member;

wherein said at least one grass entry prevention member being integrally formed as part of said fuel tank;

wherein said at least one grass entry prevention member being located so as to be near an air inlet port of the engine in order to prevent grass from entering the air inlet port; and each of said at least one grass entry prevention member being planar along a flow direction of air entering said air inlet port.

* * * * *